United States Patent [19]

Swenson

[11] 4,266,929

[45] May 12, 1981

[54] FLUID ACTUATED DAMPER CONTROL APPARATUS

[76] Inventor: Paul F. Swenson, 25525 Edgecliffe, Euclid, Ohio 44132

[21] Appl. No.: 88,860

[22] Filed: Oct. 29, 1979

Related U.S. Application Data

[63] Continuation of Ser. No. 933,355, Aug. 14, 1978, abandoned, which is a continuation-in-part of Ser. No. 881,733, Feb. 27, 1978, Pat. No. 4,182,483, which is a continuation-in-part of Ser. No. 704,548, Aug. 12, 1976, Pat. No. 4,076,171.

[51] Int. Cl.[3] ..... F23N 3/00

[52] U.S. Cl. ..... 431/20; 236/1 G

[58] Field of Search ..... 236/1 G; 431/20; 126/285 B

[56] References Cited

U.S. PATENT DOCUMENTS

| | | | |
|---|---|---|---|
| 1,813,395 | 7/1931 | Fraser | 122/17 |
| 2,263,817 | 11/1941 | Ourusoff | 236/1 G |
| 2,296,410 | 9/1942 | Wetzsteon | 236/1 G |
| 4,076,171 | 2/1978 | Swenson | 91/400 |
| 4,182,483 | 1/1980 | Swenson | 236/1 G |

FOREIGN PATENT DOCUMENTS

| | | | |
|---|---|---|---|
| 966361 | 8/1957 | Fed. Rep. of Germany | 236/1 G |
| 1013027 | 8/1957 | Fed. Rep. of Germany | 431/20 |

*Primary Examiner*—Carroll B. Dority, Jr.

[57] ABSTRACT

An apparatus for opening and closing the draft hood discharge opening and vent and fuel line of a fluid fuel-fired heating device such as a domestic water heater. The disclosed apparatus includes a diaphragm-type expansible chamber fluid motor assembly mechanically linked to a damper assembly such that when the heating devices call for heating, the supply of pressurized fuel acts to actuate the motor for opening the damper assembly. The motor assembly also has a pressure output line which operates a fail-safe type of diaphragm valve for controlling flow. This prevents burner operation until after the dampers are open. Additionally, when the supply of fuel is terminated, the motor assembly does not close the damper assembly until after the diaphragm valve stops fuel to the burner.

3 Claims, 8 Drawing Figures

51'
122'
92'
60'
68'
70'
78'
124'
10'
123
12
106
22'
122
120
26'
144
24'
36'
36
127
126
130
128
129
136
134
32
32'
40'
138
140
142

FLUID ACTUATED DAMPER CONTROL APPARATUS

BACKGROUND OF THE INVENTION

This is a continuation of application Ser. No. 933,355, filed Aug. 14, 1978 and now abandoned, which is a continuation-in-part of my prior application Ser. No. 881,733 filed Feb. 27, 1978, now U.S. Pat. No. 4,182,483, which was a continuation-in-part of my application Ser. No. 704,548, filed Aug. 12, 1976, now U.S. Pat. No. 4,076,171, for Damper Control Apparatus.

The subject invention is directed toward the art of heating apparatus and, more particularly, to a vent or stack damper control system for a combustion-type heating apparatus.

The invention is particularly suited for use on gas-fired water heaters and will be described with reference thereto; however, the invention is capable of broader application and could be used on many different types of fluid fuel-fired furnaces, boilers and similar heating devices.

The typical domestic fluid fuel-fired hot water heater comprises a vertically-extending tank with a central vent tube positioned axially thereof. A fluid fuel burner is positioned beneath the tank and is controlled by a thermostatic valve responsive to the temperature of the water within the tank. The water within the tank is, of course, heated by the hot combustion products impinging against the bottom of the tank and traveling through the vent tube. Generally, the exit end of the vent tube is connected through a draft hood with a chimney or stack to convey the combustion products to a location exterior of the building.

The general arrangement described above is in widespread use. One of the major disadvantages is, however, a comparatively low, overall thermal efficiency. For example, during those periods when the burner is not firing, natural thermosyphonic action induces a continual flow of air through the vent tube and up the stack. This causes thermal losses in terms of loss of heated air from the building and cooling of the heated water in the tank. The natural cooling of the heated water causes the burner to be cycled on-and-off even during periods when no heated water is being used.

Various approaches for overcoming the noted losses have been proposed in the prior art. For example, see the following U.S. Pat. Nos:

| | |
|---|---|
| Allman | 1,336,937 |
| Stinson | 1,959,970 |
| Gilliland | 2,130,491 |
| Firehammer | 2,179,120 |
| Woods | 2,218,061 |
| Stringer | 2,224,705 |
| Viola | 2,557,210 |
| Hodgins | 3,010,451 |

Generally, the systems shown in the noted patents are unsatisfactory for at least one of several reasons. That is, the systems are either complex, cumbersome, and expensive and/or they require an electrical supply. In addition, the prior systems generally do not provide any means for preventing losses due to heated building air entering the draft hood and going up the chimney.

Because of the problems and disadvantages of the prior systems, they have generally not been suitable for commercial applications either as original equipment or as retrofit units for incorporation in existing equipment.

The system described and claimed in my above-mentioned prior application provides an apparatus which overcomes the problems of prior systems and allows both the heating appliance vent pipe or draft hood to be closed in coordinated relationship with the operation of the burner. In particular, according to one aspect of the invention, a heating apparatus of the type having a fluid fuel burner, a vent pipe for discharging the products of combustion produced by the burner and a valved supply line for supplying pressurized fluid fuel to the burner is provided with the improvement which includes at least one damper means movable between open and closed positions for controlling flow through the vent pipe. An expansible chamber motor means is connected with the damper means for moving it to an open position when pressurized fluid is supplied to the motor means. Additionally, a connection is provided for depressurizing the motor means after the valve means is in a closed position.

Preferably, and in accordance with a further aspect of the invention, means are also provided for preventing the flow of fuel to the burner until the damper means are in an open position. These means generally comprise a valve element operated by the fluid motor after the damper means have been moved to an open position.

BRIEF DESCRIPTION OF THE SUBJECT INVENTION

The subject invention provides an improvement to my prior invention in that it is more suitable for installation on existing heating apparatus in that it allows the mechanical linkage between the damper and the expansible chamber motor means to be short and compact without substantial revision of the gas supply line configuration. Additionally, the entire system can be compact and operate in a fail-safe mode.

In particular, according to the subject invention, the damper-operating fluid motor means is connected downstream of the main, thermostatically-controlled gas supply valve and arranged to operate the damper assembly to an open position when the gas supply valve is opened. A pressure-operated valve is positioned in the gas supply line between the gas supply valve and the burner. A pressure bleed line extends from the fluid motor means for pressurizing and opening the pressure-operated valve only after the damper assembly has been opened.

Because of the above-described arrangement, the fluid motor means can be located close to the damper assembly and only small vent or bleed line extending between the motor means and the main gas supply line and the pressure-operated valve are required.

OBJECTS OF THE INVENTION

Accordingly, a primary object of the invention is the provision of a simple and reliable apparatus for preventing heat losses from a fluid fuel-fired heating apparatus when in a standby mode of operation.

Another object is the provision of an apparatus of the general type described which operates without the need of an electrical power supply.

Still another object is the provision of a damper control apparatus which is comparatively simple in construction and can be installed in new equipment or retrofitted to existing equipment.

Still another object is the provision of an apparatus of the general type described wherein the dampers are open well prior to the firing of the burner and close slowly after burner operation ceases.

A still further object of the invention is the provision of a system of the type under consideration wherein all power required for operating the system is obtained from the pressure of the fuel being supplied to the burner.

BRIEF DESCRIPTION OF THE DRAWINGS

The above and other objects and advantages will become apparent from the following description when read in conjunctions with the accompanying drawings wherein.

DETAILED DESCRIPTION OF THE DRAWINGS

Figure 1:
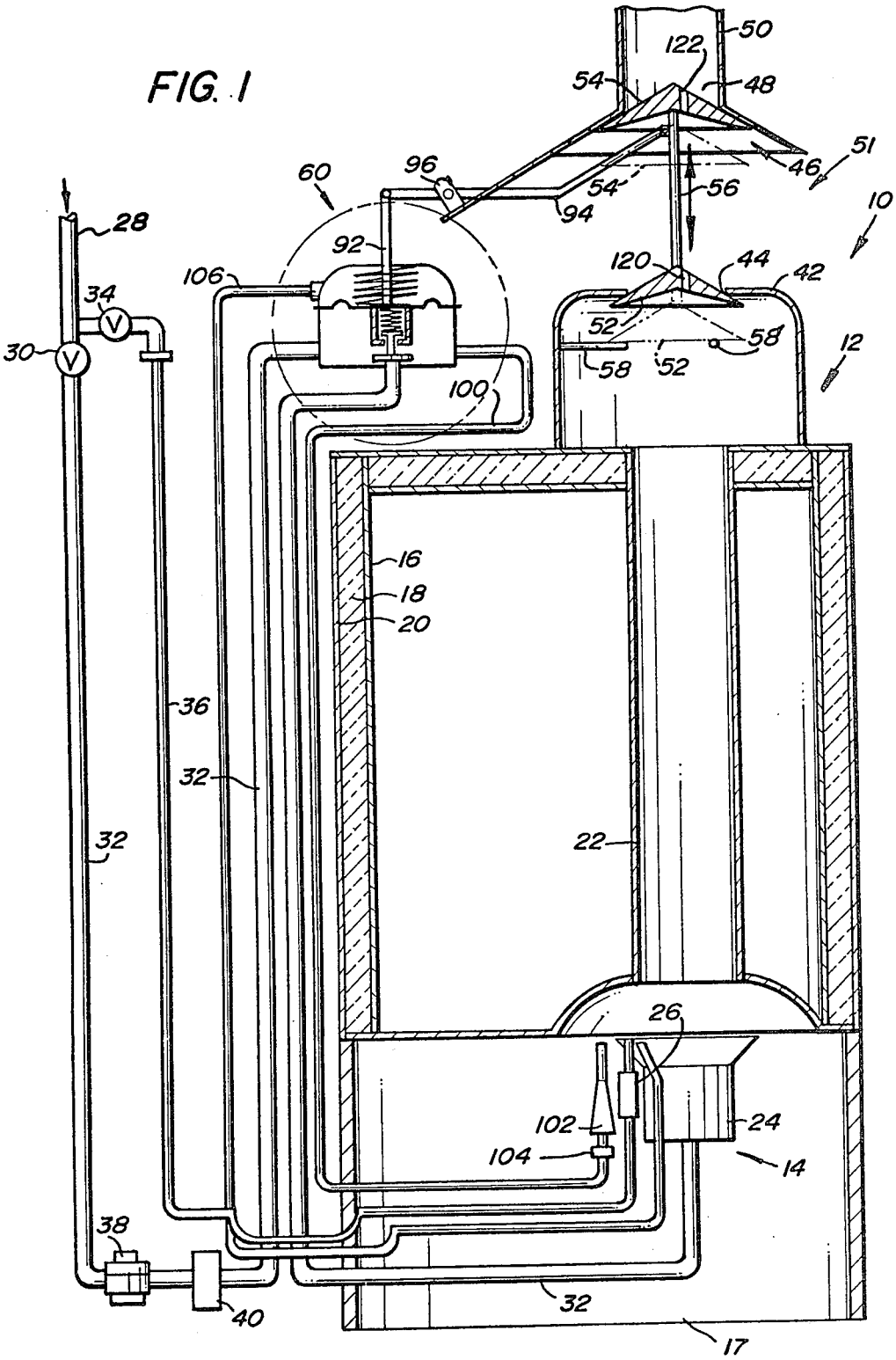
FIG. 1 is a somewhat diagrammatic view showing the overall arrangement of a damper control system formed in accordance with the subject invention.

Referring in particular to the drawings wherein the showings are for the purpose of illustrating a preferred embodiment of the invention only, and not for the purpose of limiting same, FIG. 1 shows, in diagrammatic form, a comparatively conventional domestic-type hot water heating unit 10 including a water storage tank unit 12 and a burner assembly 14. The tank assembly 12 comprises a generally cylindrical storage tank 16 supported from a base 17 and provided with water supply and discharge connections not shown. The tank 16 is suitably insulated by insulation 18 covered by a sheet metal housing or shell 20.

Extending vertically through the tank 16 is a vent tube 22 which serves to discharge the products of combustion produced by the burner assembly 14 and, also, to conduct heat to the water within the tank 16.

The apparatus thus far described is conventional and, as mentioned earlier, produces certain inherent thermal inefficiencies. For example, during the period when the burner is not firing, the heated water within tank 16 tends to produce natural thermosyphonic action with respect to the flue tube 22. That is, the air column within the flue 22 is heated and rises causing a constant flow of air vertically through the flue tending to cool the water. Consequently, even though the tank is insulated, a substantial heat loss takes place from the water and, as a result, the burner is required to periodically cycle on-and-off to maintain the desired water temperature even though no hot water is being withdrawn from the tank.

The subject invention provides a system whereby the heat losses through the noted thermosyphonic action can be reduced and substantially eliminated. Specifically, as shown, the apparatus includes a discharge plenum or chamber 42 positioned at the outlet end of flue 22. A central discharge opening 44 is formed in the plenum 42 for permitting the flow of combustion products to enter the inlet 46 of a draft hood 48. As is customary, the draft hood 48 is connected through an outlet duct 50 with a chimney or stack (not shown) for conducting the products of combustion exteriorly of the building. According to the subject invention, damper means 51 are provided for operation to close off the outlet from the flue tube 22, as well as the discharge opening of the draft hood whenever the main burner 14 is not operating. While the damper means 51 could take a variety of constructions within the scope of the invention, it is specifically shown as including a first damper member 52 arranged to move from an outlet closing position shown in solid lines to an outlet open position shown in phantom. A second damper member 54 is arranged to close the draft hood discharge opening and move from the closed or solid-line position to the open or phantom position. In the subject embodiment, the dampers 52 and 54 positively interconnected by a vertical rod 56. Downward movement of the dampers 52 and 54 is limited by rods or stop members 58 which extend inwardly from the walls of the plenum 42.

Figure 2:
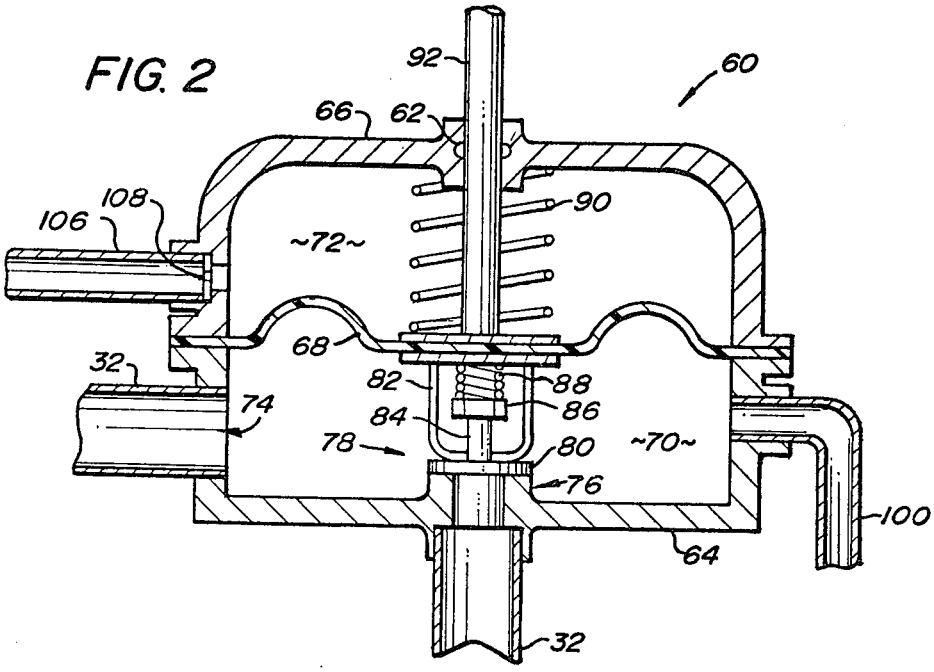
FIG. 2 is an enlarged view of the circled area of FIG. 1 showing in detail the preferred construction of the damper actuation and control assembly.
Figure 3:
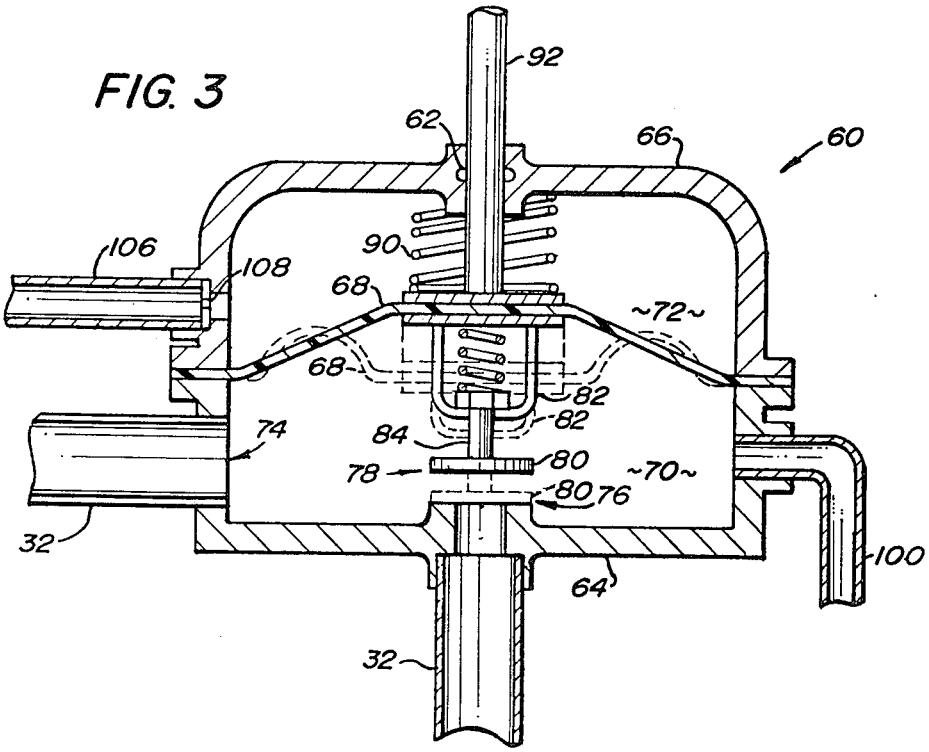
FIG. 3 is a view similar to FIG. 2 but showing the apparatus in a position to maintain the damper assembly in its open condition.

Of particulr importance to the subject invention is the arrangement whereby the dampers 52, 54 are moved in coordinated relationship with the firing of main burner assembly 14. In particular, according to the subject invention, an expansible chamber motor means 60 is positioned in the main gas supply line 32 between the control valve 40 and the gas burner 24. The expansible chamber motor means 60 could have many specific constructions; however, the preferred construction is best seen in FIGS. 2 and 3. Referring in particular to FIG. 2, it will be noted that the expansible chamber motor means 60 preferably includes a lower chamber-defining section 64 and an upper section 66. Clamped in sealed relationship between housing sections 64 and 66 is a flexible diaphragm member 68 which divides the interior of the housing into a sealed lower chamber 70 and an upper chamber 72. The housing assembly is connected to the main gas supply line 32 and enters the lower chamber 70 at an inlet opening 74 and leaves the chamber at an outlet opening 76.

A valve assembly 78 is positioned to control the flow through the outlet opening 76. As shown, the valve assembly 78 includes a valve member 80 carried and guided by a member 82 which extends downwardly and is supported from the diaphragm 68. The valve 80 includes an upwardly-extending shaft portion 84 which is slidably received in the lower wall of the support 82. A stop member 86 is mounted at the upper end of the shaft 84 for engagement with the bottom wall of support 82. The valve member 80 is maintained under a continual downward bias by a comparatively light compression spring 88 positioned between the diaphragm 68 and the top of stop member 86.

The diaphragm member 68 is also maintained under a light, continual downwardly-directed bias by a compressing spring 90 positioned between the top housing section 66 and the top surface of the diaphragm 68. Additionally, as will be noted, an actuating rod 92 extends upwardly through the seal means 62 from the diaphragm 68 into pivotal engagement with a lever 94 mounted for rocking movement about a pivot support 96 carried from the draft hood 48 (see FIG. 1). The right-hand end of the lever 94 is pivotally connected to the vertically-extending shaft 56 between the dampers 52, 54.

OPERATION OF THE PREFERRED EMBODIMENT

The operation of the apparatus thus far described will now be explained. Assume that valves 30 and 34 are in their normally open position and that the pilot burner 26 is operating. When valve 40 is opened, indicating a need for operation of the main burner 24, gas enters the lower chamber 70 of the expansible chamber motor means 60. Upon pressurization of chamber 70, the diaphragm 68 is actuated upwardly from the dotted-line position of FIG. 3. This, of course, causes the actuating rod 92 to move upwardly and fully open the dampers 52, 54. It should be noted that until the movement of the diaphragm causes support member 82 to lift stop member 86, the valve 80 is still seated against the outlet 76. Consequently, the dampers are open but no gas can flow through the outlet 76 to the burner 24. Continued upward movement of the diaphragm 68 causes the valve 80 to open, supplying gas to the burner 24.

Upon closing of valve 40 (or normally-open valve 80), the supply of gas to chamber 70 is discontinued. Consequently, the pressure acting against the underside of diaphragm 68 is relieved and the diaphragm moves downwardly under the influence of gravity and the compression spring 90. Downward movement continues until valve 80 seats against outlet 76 completely blocking the flow of gas through outlet 76. At this point, the dampers are still in a full open position. However, downward movement of the diaphragm 68 can continue at a controlled rate by virtue of a bleed line 100 which extends from chamber 70 to a vent pilot 102. The rate at which the gas is allowed to vent can be varied by changing a flow orifice member 104 positioned in the vent pilot 102. Additionally, a second small vent line 106 extends from chamber 72 to pilot 26 to relieve pressure within chamber 72 and to provide a safe discharge of gas if the diaphragm should rupture. The final downward movement of the diaphragm 68 causes the damper members 52, 54 to move to their final closed positions shown in FIG. 1.

Because the dampers 52, 54 are closed, there can be no thermosyphonic action producing a flow of air through the vent tube 22 to cause cooling of the water within the tank 1. Additionally, since the draft hood 46 is also closed, building air cannot circulate up the chimney or stack to cause additional heat losses. It should be noted that small holes 120, 122 are provided in dampers 52 and 54 to allow combustion gases from the pilot to exhaust when the unit is in standby condition. The holes are, however, sized sufficiently small to prevent any substantial heat loss due to cooling of the heated water.

It is important to note that the entire apparatus operates without the necessity of a separate electrical power supply or any other outside power source. All operation is achieved merely through the pressure of the fluid fuel being supplied through line 32.

Figure 4:
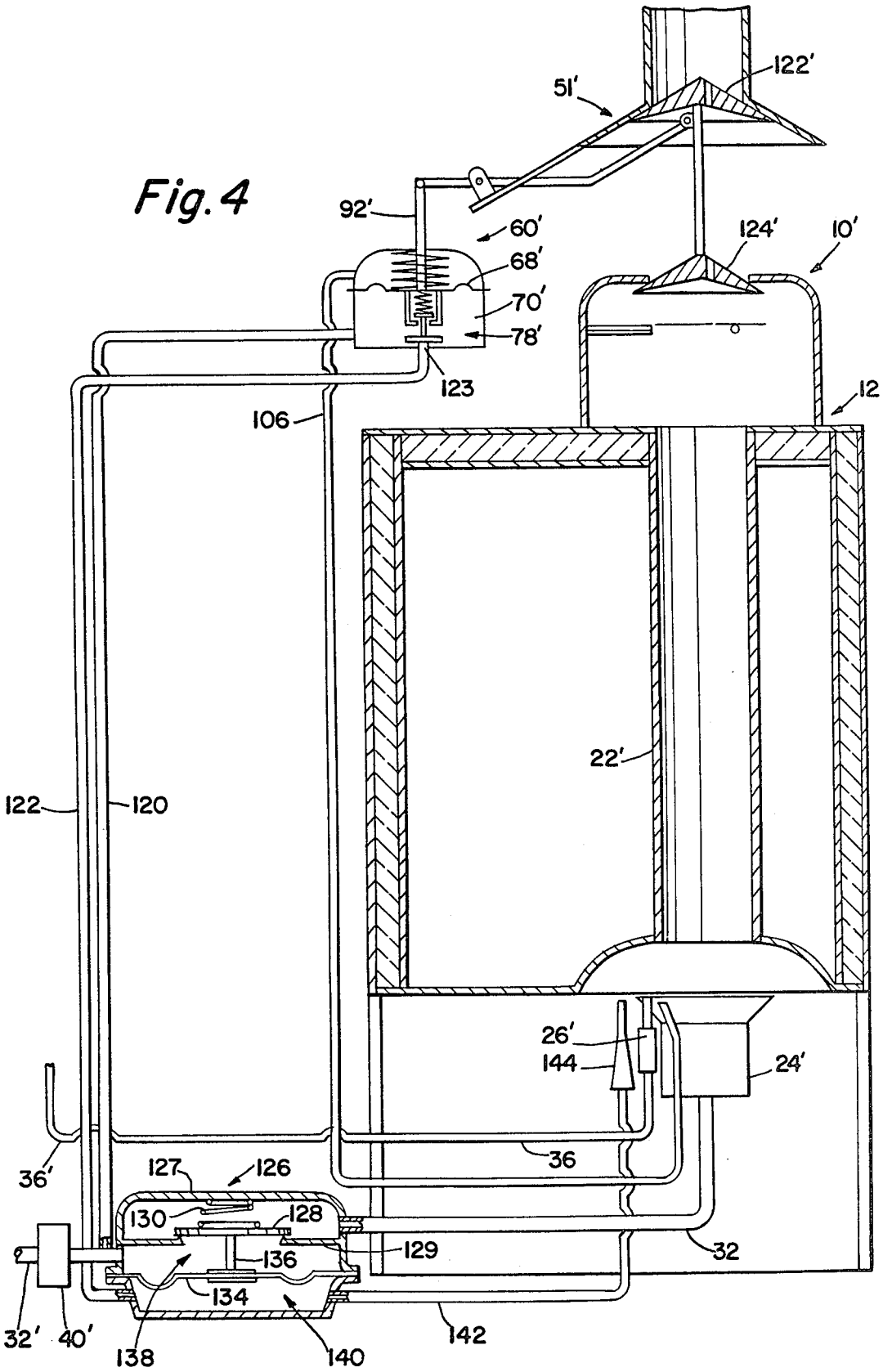
FIG. 4 is a modified form of the invention which eliminates the need for connecting the damper-actuating fluid motor directly in the main gas supply line.

FIG. 4 shows a modified system which can perform the functions of the system of FIGS. 1–3. Like reference numerals differentiated by a prime (') suffix have been used in FIG. 4 to identify the elements which correspond to the FIGS. 1–3 showings. A description of the corresponding FIGS. 1–3 element is to be taken as equally applicable to the FIG. 4 element unless otherwise noted.

In particular, the system of FIG. 4 includes a bleed line or pressure line 120 which extends from the main gas supply line 32' to chamber 70' of the fluid meter means 60'. Consequently, when the main control valve 40' is opened in response to indication of a need for burner operation, chamber 70' of motor 60' is pressurized causing diaphragm 68' to move upwardly opening the damper means 51'. Subsequently, as described with reference to the FIGS. 1–3 embodiment, the valve assembly 73' opens allowing gas to flow from chamber 70' to line 122.

Positioned in the main gas supply line 32' between the main control valve 40' and the main burner 24' is a normally closed, pressure-actuated valve 126.

As shown, valve 126 includes a housing 127 and a valve element 128 which is normally maintained in a closed position against a seat 129. A light compression spring 130 acts against the top of element 128 and an actuating rod 136 extends downwardly to a diaphragm 134. The diaphragm 134 divides the lower portion of housing 127 into a central supply chamber 138 and a lower pressure chamber 140.

Even when main control valve 40' is opened, valve element 128 is maintained closed against the pressure within chamber 138 acting against its undersurface by the pressure acting downwardly against the top of diaphragm 134. However, after valve assembly 78' of motor means 60' opens, gas is supplied to pressure chamber 150. This, of course, counterbalances the pressure on the top surface of the diaphragm. Consequently, the pressure on the undersurface of element 128 overcomes the bias of spring 130 and moves the element to the open position. This allows gas to flow to burner 24'.

Gas within chamber 140 is vented through a line 142 to a vent pilot 144. A small orifice of approximately 0.046" in diameter is mounted in pilot 144 to assure a suitable pressure buildup within chamber 140.

When the need for heating ceases, valve 40' closes. Consequently, the flow of gas to main burner 24' stops and chamber 70' of motor 60' depressurizes through a small orifice of approximately 0.0225" in diameter formed in the inlet end of line 122 at location 123. Consequently, the dampers are permitted to close.

Figure 5:
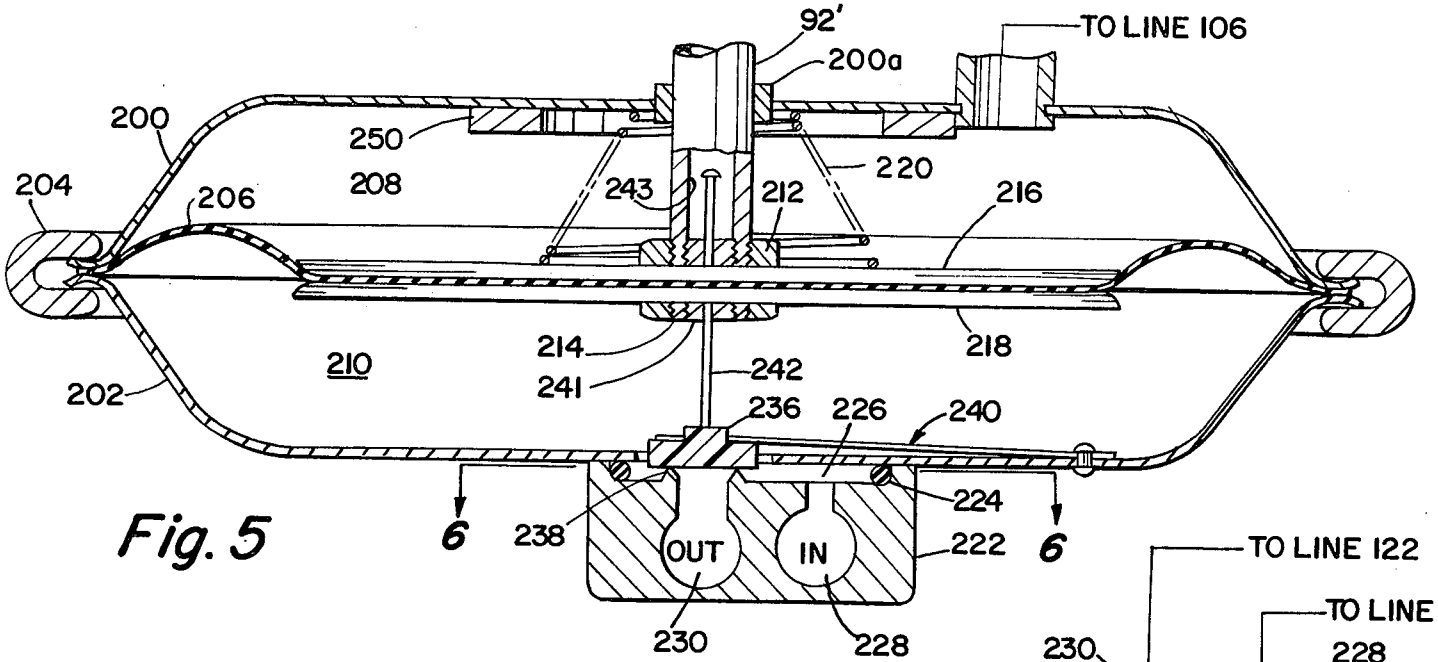
FIG. 5 is a detailed showing of the preferred construction of motor 60′ of the FIG. 4 embodiment.
Figure 6:
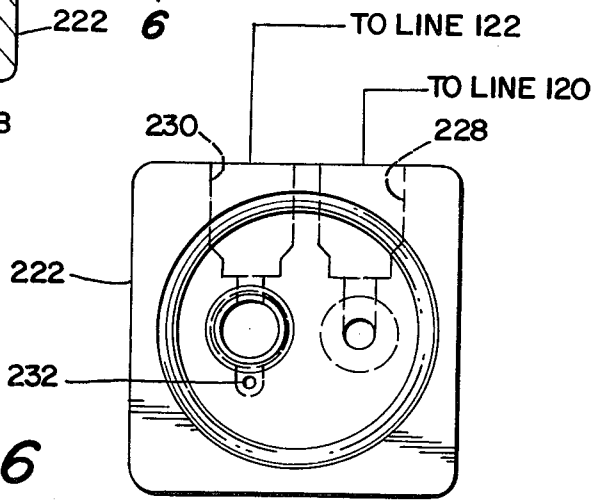
FIG. 6 is a cross-sectional view taken on line 6—6 of FIG. 5.

While it is apparent that motor 60' of the FIG. 4 embodiment could have a variety of specific structures, FIGS. 5 and 6 show a preferred structure which is particularly suited for use in an actual commercial embodiment. The FIGS. 5 and 6 structure provides a more compact assembly which simplifies piping and construction and facilitates operation under periods of extremely low fuel pressure.

Specifically, the motor of FIGS. 5 and 6 comprises dish shaped actuator body halves 200 and 202 join about their outer peripheries by a conventional clamp ring 204 to define a closed chamber. A diaphragm member 206 is clamped between the body halves 200 and 202 to divide the chamber into upper and lower halves 208 and 210, respectively. The damper actuating rod 92' extends freely in a guide bushing means **200*a* through the upper body half 200 and is connected at its lower end to diaphragm 206 for movement thereby. As shown the lower end of actuating rod 92' is threaded and extends through diaphragm 206 and is sealingly connected thereto by a pair of nuts 212 and 214 and metal disks 216 and 218. The diaphragm 206 and the actuating rod 92' are maintained under a continual downward bias by a compression spring 220**.

The fuel and bleed connections to chamber half 210 are provided through a valve block 222. Block 222 is releasably connected to the lower side of member 202 and sealed thereto by an O-ring 224 positioned in a recess 226 formed in the top of block 222.

Extending into block 222 is an inlet port 228 (see FIG. 6) which connects to recess 226 and chamber half 210. As is apparent, port 228 connects with line 120 of the FIG. 4 showing.

Block 222 also includes a valved outlet port 230 intended for connection with line 122 of the FIG. 4 embodiment. It should also be noted that a 0.0225" diameter, unvalved bleed orifice 232 connects with chamber half 210 in the manner of orifice 123 of FIG. 4.

Flow from chamber half 210 through outlet port 230 is controlled by a valve member 236 entered and maintained under a light bias toward the seat 238 by a leaf spring 240 riveted at its right end to member 202.

Dalayed actuation, of valve member 236 to an open position until after diaphragm 206 has moved to substantially a full upper position and moved actuating rod 92' to open the previously mentioned dampers 122' and 124', is provided by a lost motion connection between the lower end of rod 92' and valve 236. In the subject embodiment this connection comprises a pin member 242 floatingly joined at its lower end to valve member 236. As shown, the pin 242 is slidably received in a member 241 received in a blind bore 243 on the end of rod 92'. The upper end of pin 242 is enlarged as shown.

As can be appreciated, upward movement of diaphragm 206 and 92' continues without affecting the valve element 236 until the head of pin 242 is engaged by member 241. Thereafter, the further upward movement lifts valve member 236 from seat 238 and directly connects inlet port 228 with outlet port 230 through recess 226.

Under conditions of extremely low fuel pressure, it is possible that diaphragm 206 will not move to a full upward position. To eliminate this possibility, a permanent magnet ring 250 is connected to body member 200 as shown. Disc 216 is galvanized steel for magnetic attraction. The strength of the magnet is selected such that after the disc 216 has moved toward the magnet a predetermined amount the magnetic attraction produces, in combination with the fuel pressure, a final snapline movement. However, when the fuel pressure in chamber half 210 drops, the magnetic attraction is not sufficient due to the predetermined air gap between magnet and disc to overcome the force of spring 220 and the diaphragm 206 moves down closing valve member 236.

Figure 7:
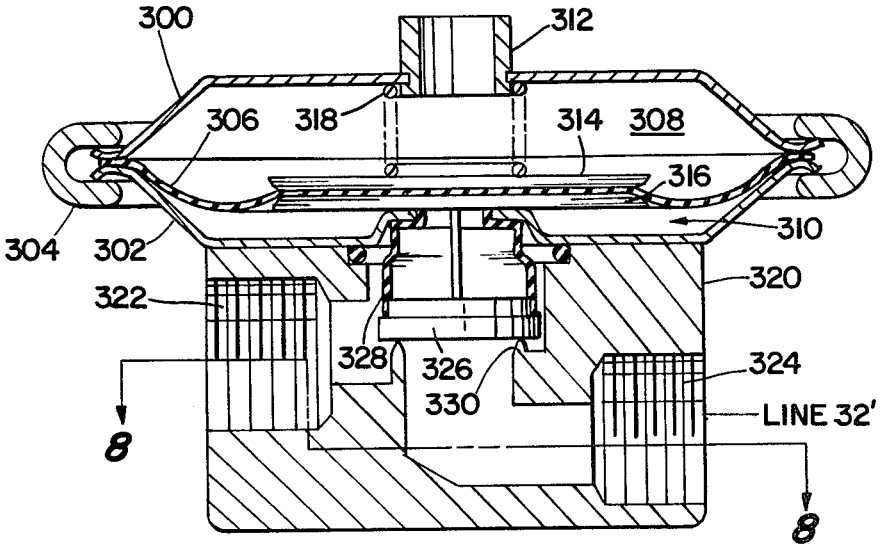
FIG. 7 is a detailed showing of a modified form of valve 126 of the FIG. 4 embodiment; and, FIG. 8 is a cross-sectional view taken on line 8—8 of FIG. 7.
Figure 8:
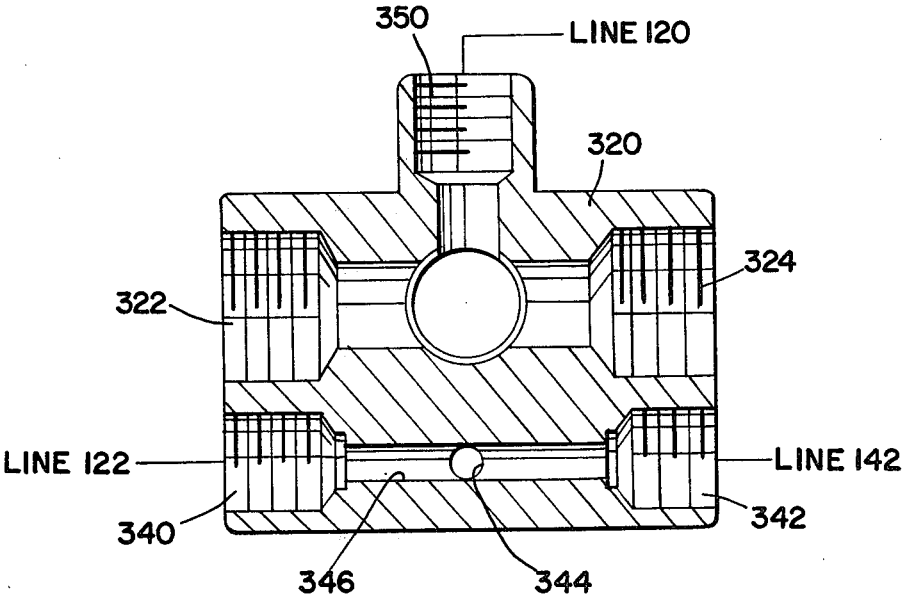

A modified arrangement for the valve assembly 126 of the FIG. 4 embodiment is shown in FIGS. 7 and 8. This embodiment is somewhat more compact, simpler to manufacture and more suitable for a commercial embodiment than the embodiment shown in FIG. 4. The embodiment shown in FIGS. 7 and 8 comprises a pair of actuator body halves 300 and 302 joined about their edges by a clamp ring 304. The chamber formed by the body halves 300 and 302 is divided by a flexible diaphragm 306 clamped therebetween to provide separate upper and lower chamber halves 308 and 310. A port 312 is provided to connect the upper chamber 308 to atmosphere or to a pilot burner for disposing of gas if diaphragm 306 should rupture.

As shown, the diaphragm 306 has disks 314 and 316 joined on opposite sides thereof. A compression spring 318 maintains a continual downward bias on diaphragm 306.

In the embodiment under consideration a valve block 320 is sealingly connected to the underside of the member 302. Valve block 320 (See FIG. 8) includes a main gas inlet port 322 for connection to line 32' downstream of the main valve 40' of the FIG. 4 embodiment. An outlet port 324 is provided for connection through line 32' to main burner 24'.

Flow from inlet port 322 to outlet port 324 is controlled by a valve element 326. A generally cylindrical rubber boot 328 is sealingly joined about its lower end with valve element 326 and about its upper end with the under-surface of member 302. The boot seals the chamber 310 but can flex to permit upward movement of the valve element 326 away from seat 330 to allow flow from inlet 322 to outlet 324. Movement of valve element 326 is, of course, controlled directly from diaphragm 306 by a pin 332 joined between disk 316 and valve element 326.

In order to pressurize chamber 310 to produce movement of the valve element 326, the valve block 320 also includes an inlet 340 for connection with line 122 of FIG. 4. Similarly, an outlet 342 directly connects with inlet 340 and is connected with line 142 leading to orificed pilot 144 of FIG. 4. A vertically extending passage 344 connects the passage 346 with chamber 310. Consequently, when line 122 of FIG. 4 is pressurized by opening of valve 60' of the FIG. 4 embodiment or valve 236 of the FIG. 6 modification, chamber 310 is pressurized to thereby open valve 326 and allow gas to flow to burner 24'.

Referring again to FIG. 8 it will be seen that valve block 320 also includes an outlet 350 which is directly connected with inlet 322 about boot 328. Outlet 350 is connected with line 120 of the FIG. 4 showing such that when main gas valve 40' opens, flow immediately goes through the valve block 320 to line 120 and the chamber 70' of motor 60' or chamber 210 of the FIG. 5 version of the motor.

While the system has been described with reference to a gas-fired water heater, it is, of course, obvious that the invention could equally well be applied to any pressurized fluid fuel system on substantially any type of heating apparatus including furnaces and the like.

The invention has been described in great detail sufficient to enable one of ordinary skill in the art to make and use the same. Obviously, modifications and alterations of the preferred embodiment will occur to others upon a reading and understanding of the specification and it is my intention to include all such modifications and alterations as part of my invention insofar as they come within the scope of the appended claims.

The invention claimed is:

1. In a fuel fired heating apparatus including a fluid fuel burner, a vent for discharging the products of combustion produced by said burner, a damper means in said vent, and a fluid motor means operated by pressure of the fluid fuel supplied to the burner for moving said damper means between open and closed positions in coordinated relationship with the firing of said burner, the improvement comprising:

actuating means associated with said fluid motor means to assure movement of said damper means to an open position during periods of abnormally low fuel pressure being supplied to said burner, said actuating means including at least one magnet member positioned to provide a damper means opening force additive to the force produced by said fluid motor.

2. The apparatus as defined in claim 1 including a fluid actuated valve for controlling fuel flow to the burner and control means associated with said fluid motor means for preventing flow of fluid to said burner until said damper means is moved to the open position.

3. The apparatus as defined in claim 2 wherein said control means includes a valve operated by said fluid motor.

* * * * *